US009810219B2

(12) United States Patent
Suitou et al.

(10) Patent No.: US 9,810,219 B2
(45) Date of Patent: Nov. 7, 2017

(54) MOTOR-DRIVEN COMPRESSOR INCLUDING A COUPLING STRUCTURE HAVING A PROTRUSION AND INSERTION PORTION

(71) Applicant: KABUSHIKI KAISHA TOYOTA JIDOSHOKKI, Kariya-shi, Aichi-ken (JP)

(72) Inventors: Ken Suitou, Kariya (JP); Yusuke Kinoshita, Kariya (JP); Shingo Enami, Kariya (JP); Junya Yano, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 0 days.

(21) Appl. No.: 14/222,842

(22) Filed: Mar. 24, 2014

(65) Prior Publication Data

US 2014/0294624 A1 Oct. 2, 2014

(30) Foreign Application Priority Data

Mar. 26, 2013 (JP) ..... 2013-064337

(51) Int. Cl.
*F04D 13/06* (2006.01)
*F04C 29/04* (2006.01)
(Continued)

(52) U.S. Cl.
CPC ..... *F04C 29/047* (2013.01); *F04C 15/0096* (2013.01); *F04C 18/0215* (2013.01);
(Continued)

(58) Field of Classification Search
CPC .. F04C 29/047; F04C 29/045; F04C 2240/80; F04C 2240/803; F04C 2240/403;
(Continued)

(56) References Cited

U.S. PATENT DOCUMENTS 6,012,909 A * 1/2000 Sloteman et al. ..... 417/366
6,599,104 B2 7/2003 Saito et al.
(Continued)

FOREIGN PATENT DOCUMENTS

CN 102245899 A 11/2011
JP 6022886 U 2/1985
(Continued)

OTHER PUBLICATIONS

Communication dated May 22, 2015 from the Korean Intellectual Property Office in counterpart application No. 10-2014-0033986.
(Continued)

*Primary Examiner* — Devon Kramer
*Assistant Examiner* — Stephen Mick
(74) *Attorney, Agent, or Firm* — Sughrue Mion, PLLC

(57) ABSTRACT

A motor-driven compressor that includes a compression unit, an electric motor, a housing, a cover, and a motor driving circuit. A metal terminal electrically connects the electric motor to the motor driving circuit. A coupling base is coupled to the housing, and the motor driving circuit is coupled to the coupling base. Each of the coupling base and the housing includes an insertion portion through which the metal terminal is inserted. At least one of the coupling base and the housing includes a protrusion. The protrusion is separated from the insertion portions. At least the other of the coupling base and the housing includes a receiving portion that receives the protrusion. The coupling base is positioned relative to the housing by connection of the insertion portion of the coupling base and the insertion portion of the housing and by engagement of the protrusion and receiving portion.

15 Claims, 5 Drawing Sheets

(51) Int. Cl.
*F04C 15/00* (2006.01)
*F04C 18/02* (2006.01)

(52) U.S. Cl.
CPC .... *F04D 13/0693* (2013.01); *F04C 2240/403* (2013.01); *F04C 2240/803* (2013.01); *F04C 2240/808* (2013.01)

(58) Field of Classification Search
CPC ..... F04C 2240/808; F04C 15/0096; F04B 39/06; F04B 39/064; F04B 39/066; F04D 29/5806; F04D 13/0653; F04D 13/0693
USPC ..... 417/371, 366; 310/52
See application file for complete search history.

(56) References Cited

U.S. PATENT DOCUMENTS

| | | | | |
|---|---|---|---|---|
| 7,972,123 | B2 | 7/2011 | Koide et al. | |
| 8,303,271 | B2 | 11/2012 | Ikeda et al. | |
| 2001/0012489 | A1* | 8/2001 | Harakawa | F04C 29/045 417/371 |
| 2004/0109772 | A1* | 6/2004 | Ogawa | F01C 21/10 417/410.5 |
| 2005/0201873 | A1* | 9/2005 | Ogawa et al. | 417/366 |
| 2007/0063594 | A1* | 3/2007 | Huynh | 310/59 |
| 2009/0033181 | A1* | 2/2009 | Hamada | 310/68 R |
| 2010/0209266 | A1* | 8/2010 | Ikeda et al. | 417/410.1 |
| 2011/0256002 | A1 | 10/2011 | Ikeda | |
| 2012/0183420 | A1 | 7/2012 | Taguchi | |
| 2013/0119834 | A1* | 5/2013 | Nakagami et al. | 310/68 D |

FOREIGN PATENT DOCUMENTS

| | | | |
|---|---|---|---|
| JP | 2002-188573 | A | 7/2002 |
| JP | 2005146862 | A | 6/2005 |
| JP | 2008-19767 | A | 1/2008 |
| JP | 2009117549 | A | 5/2009 |
| JP | 2009-150248 | A | 7/2009 |
| JP | 2011089515 | A | 5/2011 |
| WO | 2012/098624 | A1 | 7/2012 |

OTHER PUBLICATIONS

Communication dated Mar. 30, 2015 from the European Patent Office in counterpart application No. 14161263.0.

Communication dated Nov. 23, 2015 from the State Intellectual Property Office of People's Republic of China issued in corresponding application No. 201410110791.3.

* cited by examiner

MOTOR-DRIVEN COMPRESSOR INCLUDING A COUPLING STRUCTURE HAVING A PROTRUSION AND INSERTION PORTION

BACKGROUND OF THE INVENTION

The present invention relates to a motor-driven compressor.

Generally, a motor-driven compressor includes a housing that accommodates a compression unit, which compresses refrigerant, and an electric motor, which drives the compression unit. A cover is coupled to the housing. A motor driving circuit, which drives the electric motor, is arranged between the housing and the cover. The motor driving circuit includes a flat circuit board and various types of electric components arranged on the circuit board. The housing includes an end wall having a through hole that receives a sealing terminal. The sealing terminal includes a metal terminal, which is electrically connected to the motor driving circuit, and an insulator, which fixes the metal terminal to the end wall of the housing and insulates the metal terminal from the end wall. The metal terminal includes an end electrically connected to the motor driving circuit by a cable. The other end of the metal terminal extends into the housing through the through hole and is electrically connected to a connector of the electric motor.

In the motor-driven compressor, the electric motor is driven when power, which is controlled by the motor driving circuit, is supplied to the electric motor through the metal terminal and the connector of the electric motor. The driven electric motor drives the compression unit to draw refrigerant into the housing, compress the refrigerant with the compression unit, and discharge the refrigerant out of the housing (into an external refrigerant circuit, for example).

The circuit board and the electric components may be combined with a coupling base to form a module that facilitates the maintenance of the motor driving circuit. In this case, the circuit board, which is connected in advance to one end of the metal terminal by a cable, and the electric components are coupled to the coupling base. The coupling base is coupled to the cover with bolts, and the cover is then coupled to the housing with bolts. When the cover is coupled to the housing, the other end of the metal terminal is extended through the through hole of the housing and electrically connected to the connector of the electric motor.

The motor driving circuit exchanges heat through the coupling base and the housing with the refrigerant that is drawn into the housing. This cools the motor driving circuit. However, when the hot highly-pressurized refrigerant compressed in the compression unit exchanges heat with the refrigerant drawn into the housing (pre-compressed refrigerant) through the housing, the refrigerant that is drawn into the housing is heated. This degrades the cooling capability of the motor driving circuit.

To solve this problem, Japanese Laid-Open Patent Publication No. 2002-188573 describes a coupling base (base plate) that includes an elongated groove and a refrigerant inlet, which is in communication with one end of the groove. The refrigerant inlet receives refrigerant from outside the housing (for example, from an external refrigerant circuit). The other end of the groove is in communication with the interior of housing through a refrigerant suction hole formed in the housing. The refrigerant supplied to the refrigerant inlet from outside the housing flows into the elongated groove and is drawn into the housing through the refrigerant suction hole. The refrigerant flowing through the elongated groove exchanges heat with the motor driving circuit through the coupling base. The refrigerant in the groove is not easily affected by the heat from the hot highly-pressurized refrigerant that is compressed in the compression unit. This improves the cooling capability of the motor driving circuit.

However, when coupling the coupling base to the housing in the structure described in the publication, the coupling base may rotate about the axis of the metal terminal relative to the housing. This may cause difficulties when coupling the coupling base to the housing.

SUMMARY OF THE INVENTION

It is an object of the present invention to provide a motor-driven compressor that improves the cooling capability of the motor driving circuit and facilitates the coupling of the coupling base to the housing.

To achieve the above object, one aspect of the present invention is a motor-driven compressor that includes a compression unit adapted to compress refrigerant, an electric motor adapted to drive the compression unit, and a housing that accommodates the compression unit and the electric motor. A cover is coupled to the housing. A motor driving circuit is arranged between the housing and the cover and adapted to drive the electric motor. A metal terminal electrically connects the electric motor to the motor driving circuit. A coupling base is coupled to the housing, and the motor driving circuit is coupled to the coupling base. A refrigerant passage is arranged in the coupling base, and the refrigerant flows through the refrigerant passage. Each of the coupling base and the housing includes an insertion portion through which the metal terminal is inserted in an inserting direction. At least one of the coupling base and the housing includes a protrusion that extends in a direction parallel to the inserting direction. The protrusion is separated from the insertion portions by a predetermined distance. At least the other of the coupling base and the housing includes a receiving portion that receives the protrusion. The coupling base is positioned relative to the housing by connection of the insertion portion of the coupling base and the insertion portion of the housing and by engagement of the protrusion and receiving portion.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

First Embodiment

Figure 1A:
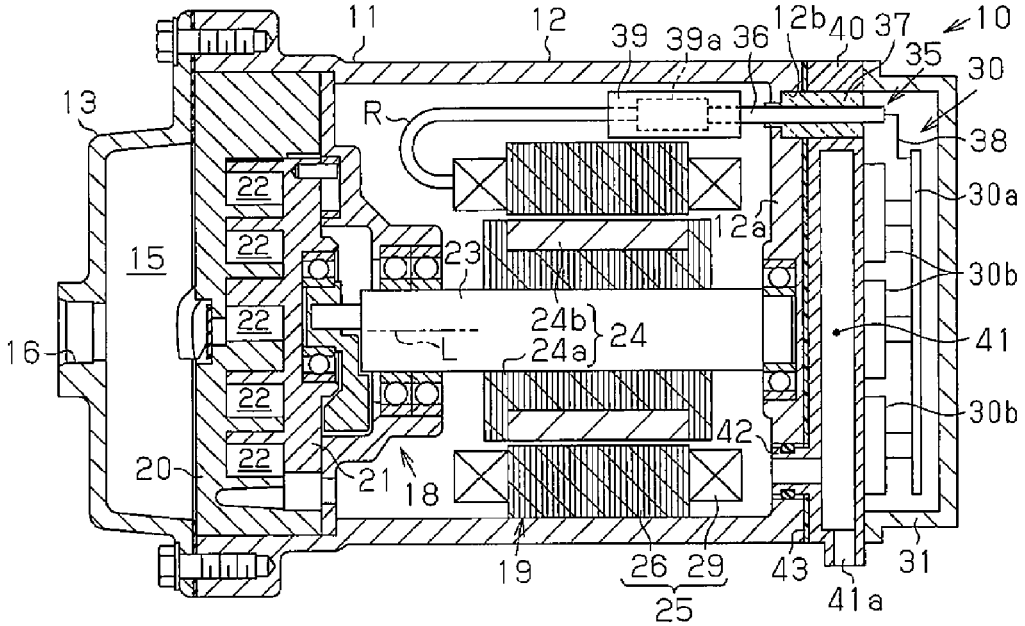
FIG. 1A is a cross-sectional view showing a motor-driven compressor of a first embodiment.
Figure 1B:
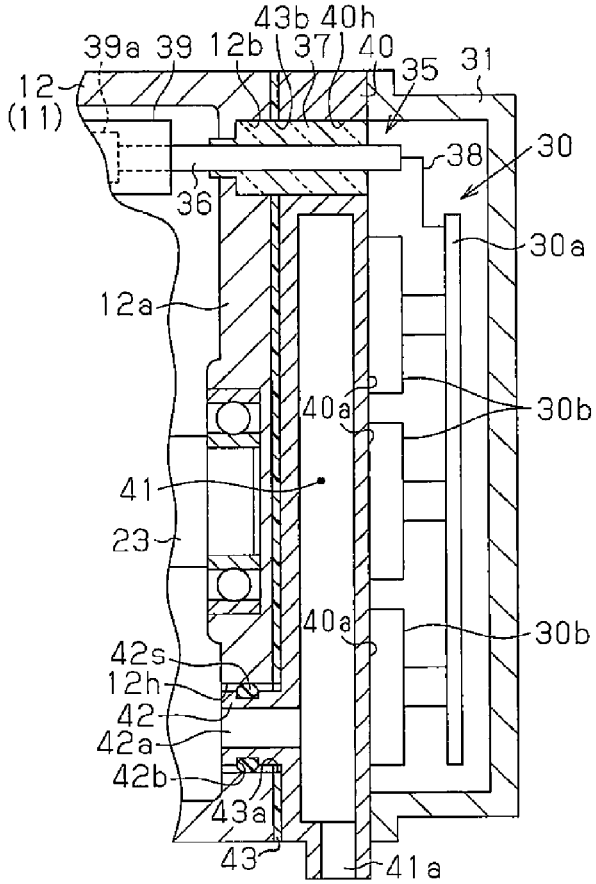
FIG. 1B is a partially enlarged view showing the motor-driven compressor of FIG. 1A.
Figure 2:
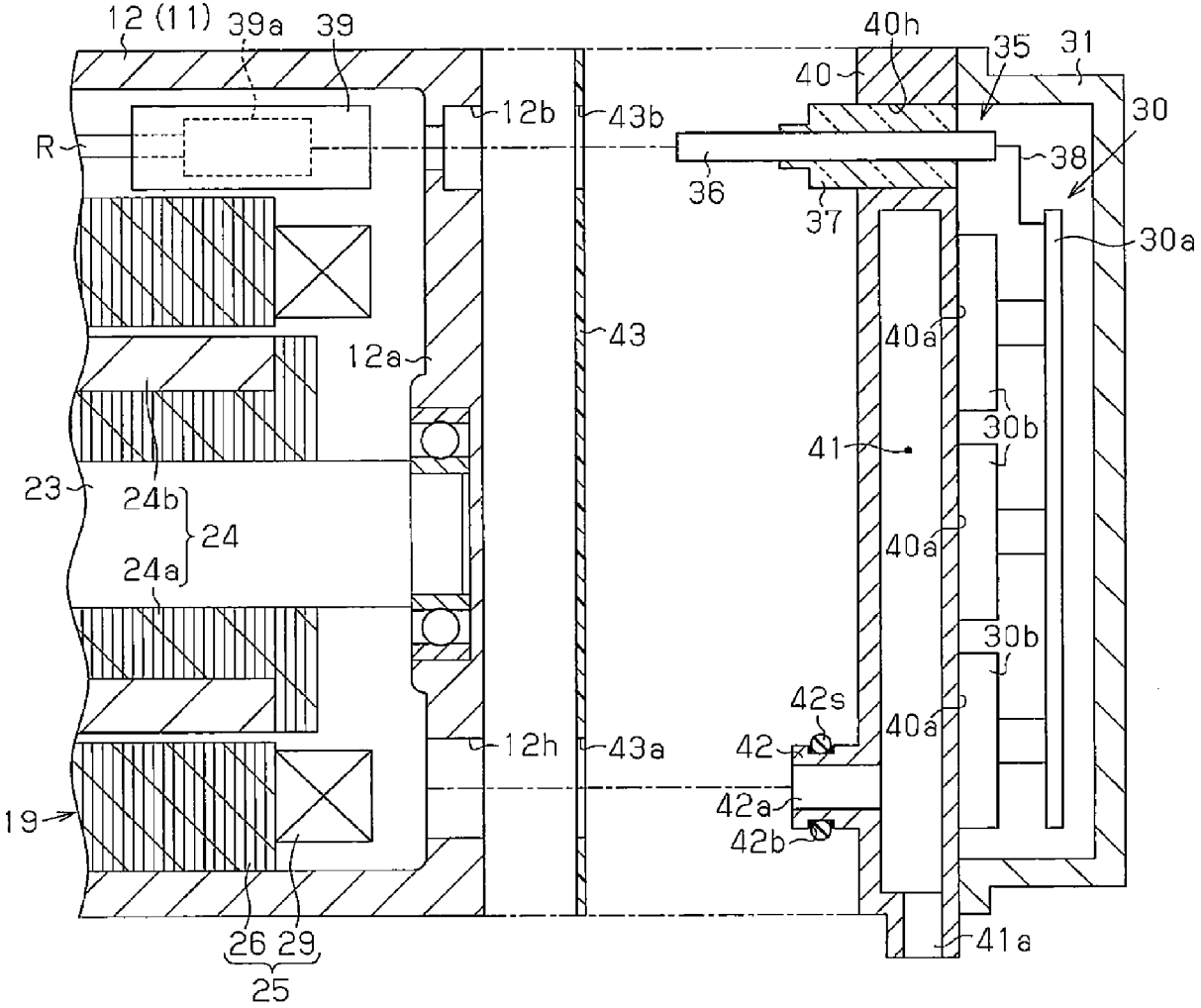
FIG. 2 is a cross-sectional view showing a cover and a coupling base before assembly to a motor housing member.

Referring to FIGS. 1A, 1B and 2, a motor-driven compressor of the first embodiment will now be described. The motor-driven compressor is installed in a vehicle and used with a vehicle air-conditioning device.

As shown in FIG. 1A, a motor-driven compressor 10 includes a housing 11 that includes a motor housing member 12 and a discharge housing member 13, which are made of metal (aluminum in the present embodiment). The motor housing member 12 and the discharge housing member 13 are cylindrical, and each includes an open end and a closed end. The discharge housing member 13 is coupled to the open end (left end as view in FIG. 1A) of the motor housing member 12. The discharge housing member 13 forms a discharge chamber 15. The end wall of the discharge housing member 13 includes a discharge port 16 connected to an external refrigerant circuit (not shown).

The motor housing member 12 accommodates a rotation shaft 23, a compression unit 18, which compresses refrigerant, and an electric motor 19, which drives the compression unit 18. The compression unit 18 and the electric motor 19 are arranged next to each other (in the horizontal direction) along the axis L of the rotation shaft 23. The electric motor 19 is closer to the end wall 12*a* of the motor housing member 12 (right side as viewed in FIG. 1A) than the compression unit 18.

The compression unit 18 includes a fixed scroll 20, which is fixed in the motor housing member 12, and a movable scroll 21, which is engaged with the fixed scroll 20. The fixed scroll 20 and the movable scroll 21 form a compression chamber 22 that has a variable volume.

The electric motor 19 includes a rotor 24, which rotates integrally with the rotation shaft 23, and a stator 25, which is fixed to the inner surface of the motor housing member 12 and surrounds the rotor 24.

The rotor 24 includes a cylindrical rotor core 24*a* fixed to the rotation shaft 23. The rotor core 24*a* includes a plurality of permanent magnets 24*b* embedded in the rotor core 24*a*. The permanent magnets 24*b* are arranged in the circumferential direction of the rotor core 24*a* at equal intervals. The stator 25 includes an annular stator core 26, which is fixed to the inner surface of the motor housing member 12, and coil 29, which is arranged on the stator core 26. Leads R of U, V, and W phases (only one shown in FIG. 1A) extend from the end of the coil 29 that faces toward the compression unit 18.

A cover 31 is coupled to the end wall 12*a* of the motor housing member 12. The cover 31, which is made of aluminum (metal), is cylindrical and has a closed end. A motor driving circuit 30 that drives the electric motor 19 is arranged between the motor housing member 12 and cover 31. Thus, in the present embodiment, the compression unit 18, the electric motor 19, and the motor driving circuit 30 are arranged in this order along the axis of the rotation shaft 23.

The motor driving circuit 30 includes a flat circuit board 30*a* and electric components including switching elements 30*b*, which are arranged on the circuit board 30*a*. The circuit board 30*a* and electric components including the switching elements 30*b* are arranged on a planar coupling base 40, which is made of aluminum (metal). The electric components including the switching elements 30*b* are heat emitting components arranged on an arrangement portion 40*a* (FIG. 1B) in the surface of the coupling base 40 that faces toward the cover 31.

The end wall 12*a* of the motor housing member 12 includes a through hole 12*b*, which functions as an insertion portion that receives a sealing terminal 35. The sealing terminal 35 includes three sets of a metal terminal 36 and a glass insulator 37 (only one set shown in FIG. 1B). The metal terminals 36 extend through the motor housing member 12 to electrically connect the electric motor 19 to the motor driving circuit 30. Each insulator 37 fixes the corresponding metal terminal 36 to the end wall 12*a* and insulate the metal terminal 36 from the end wall 12*a*. Each metal terminal 36 includes a first end, which is electrically connected to the circuit board 30*a* by a cable 38, and a second end, which extends through the through hole 12*b* into the motor housing member 12.

A cluster block 39, which is made of insulating plastic, is arranged at the outer side of the stator core 26. The cluster block 39 accommodates three connection terminals 39*a* (only one shown in FIG. 1A). Each connection terminal 39*a* electrically connects the corresponding lead R to the second end of the metal terminal 36. Thus, the leads R and the connection terminals 39*a* in the cluster block 39 serve as a connector of the electric motor 19. The rotor 24 and the rotation shaft 23 rotate integrally when power is supplied to the coil 29 through the motor driving circuit 30, the metal terminals 36, the connection terminals 39*a*, and the leads R.

As shown in FIG. 1B, the coupling base 40 defines an interior that functions as a refrigerant passage 41 in which refrigerant flows. The refrigerant passage 41 extends along the end wall 12*a* of the motor housing member 12 and overlaps with the arrangement portion 40*a* on which the electric components including the switching elements 30*b* are arranged. The refrigerant passage 41 includes a supply port 41*a* connected to an external refrigerant circuit (not shown).

The coupling base 40 also includes a tubular portion 42, which is a protrusion extending parallel to the inserting direction of the metal terminals 36. That is, the axis of the tubular portion 42 is parallel to the axis of the metal terminals 36. The tubular portion 42 is separated from the through hole 12*b* by a predetermined distance. The tubular portion 42 includes a communication passage 42*a* that communicates the refrigerant passage 41 and interior of the motor housing member 12. The end wall 12*a* of the motor housing member 12 includes an receiving hole 12*h*, which functions as a receiving portion that receives the tubular portion 42. The receiving hole 12*h* extends through the end wall 12*a* of the motor housing member 12 and is parallel to the inserting direction of the metal terminals 36.

The tubular portion 42 includes a holding groove 42*b* that extends over the entire outer circumference of the tubular portion 42. The holding groove 42*b* holds an annular seal member 42*s*. The seal member 42*s* seals the gap between the tubular portion 42 and the wall defining the receiving hole 12*h*. Further, the coupling base 40 includes a holding hole 40*h*, which functions as an insertion portion that holds the metal terminals 36 and the insulators 37. A heat insulator 43, which functions as a heat insulation layer, is arranged between the end wall 12*a* of the motor housing member 12 and the coupling base 40. The heat insulator 43 is planar and made of a material having relatively low heat conductivity (e.g., a plastic such as nylon). The heat insulator 43 includes a first through hole 43*a*, which receives the tubular portion 42, and a second through hole 43*b*, which receives the insulators 37.

The assembly of the cover 31 and the coupling base 40 to the end wall 12*a* of the motor housing member 12 will now be described.

As shown in FIG. 2, the coupling base 40, to which the circuit board 30*a* and the electric components including switching elements 30*b* are already coupled, is coupled to the cover 31 with bolts (not shown). The circuit board 30*a* is connected to the first end of each metal terminal 36 by the cable 38 in advance. Then, the cover 31, to which the coupling base 40 is coupled, is coupled to the end wall 12*a* of the motor housing member 12 with bolts (not shown). The heat insulator 43 is arranged between the end wall 12*a* of the motor housing member 12 and the coupling base 40.

The second end of each metal terminal 36 is inserted through the second through hole 43*b* of the heat insulator 43 and the through hole 12*b* of the motor housing member 12. Here, the through hole 12*b* and the holding hole 40*h* of the coupling base 40 are connected to each other by the insertion of the metal terminals 36. In addition, the tubular portion 42 is inserted into the receiving hole 12*h* through the first through hole 43*a* of the heat insulator 43. Thus, the tubular portion 42 and the receiving hole 12*h* are engaged with each other at a position separated from the through hole 12*b* and the holding hole 40*h* by the predetermined distance. The connection of the through hole 12*b* and the holding hole 40*h* and the engagement of the tubular portion 42 and the receiving hole 12*h* position the coupling base 40 relative to the motor housing member 12. This restricts rotation of the coupling base 40 about the set of metal terminals 36 relative to the motor housing member 12 when assembling coupling base 40 to the motor housing member 12. Thus, the assembly of the coupling base 40 to the motor housing member 12 is facilitated. Further, the assembly of the coupling base 40 to the motor housing member 12 electrically connects the second end of each metal terminal 36 to the corresponding connection terminal 39*a*.

The operation of the first embodiment will now be described.

Refrigerant supplied through the supply port 41*a* flows in the refrigerant passage 41 and is drawn into the motor housing member 12 through the communication passage 42*a*. The refrigerant flowing in the refrigerant passage 41 in the coupling base 40 cools the motor driving circuit 30. This limits the transfer of heat from the hot highly-pressurized refrigerant, compressed in the compression unit 18, to the refrigerant that cools the motor driving circuit 30, and improves the cooling capability of the motor driving circuit 30 compared to a structure in which the refrigerant drawn into the motor housing member 12 cools the motor driving circuit 30.

Moreover, the heat insulator 43, which is arranged between the end wall 12*a* of the motor housing member 12 and the coupling base 40, limits the transfer of heat from the hot highly-pressurized refrigerant, compressed in the compression unit 18, to the coupling base 40 through the motor housing member 12. Furthermore, the refrigerant passage 41 overlaps with the arrangement portion 40*a* on which the electric components including switching element 30*b* are arranged. This effectively cools the electric components including the switching elements 30*b*, which emit more heat than other components of the motor driving circuit 30. Thus, the cooling capability of the motor driving circuit 30 is further improved. As a result, the motor driving circuit 30 is effectively cooled even in a situation where the amount of refrigerant drawn into the motor-driven compressor 10 from the external refrigerant circuit is relatively small and the amount of heat emitted from the electric components including the switching element 30*b* is relatively large. Such a situation may occur when the motor-driven compressor 10 operates under a high load with the rotation shaft 23 rotating at a low speed.

The first embodiment has the advantages described below.

(1) The refrigerant passage 41, through which refrigerant flows, is formed in the coupling base 40. In addition, the coupling base 40 and the motor housing member 12 include the holding hole 40*h* and the through hole 12*b*, respectively, through which the metal terminals 36 are inserted. The coupling base 40 includes the tubular portion 42 extending parallel to the inserting direction of the metal terminals 36. The tubular portion 42 is arranged at a location separated from the through hole 12*b* and the holding hole 40*h* by the predetermined distance. Furthermore, the end wall 12*a* of the motor housing member 12 includes the receiving hole 12*h* that receives the tubular portion 42. The refrigerant flowing in the refrigerant passage 41 in the coupling base 40 cools the motor driving circuit 30. The hot highly-pressurized refrigerant, compressed in the compression unit 18, is inhibited from heating the refrigerant that cools the motor driving circuit 30. This improves the cooling capability of the motor driving circuit 30 compared to a structure in which the refrigerant drawn in the motor housing member 12 cools the motor driving circuit 30. When coupling the coupling base 40, which includes the motor driving circuit 30 electrically connected in advance to one end of the metal terminal 36, to the motor housing member 12, the coupling base 40 is coupled to the motor housing member 12 at where the through hole 12*b*, which receives the metal terminal 36, and the holding hole 40*h* are located. In addition, the tubular portion 42 is engaged with the receiving hole 12*h* at a location separated from the through hole 12*b* and the holding hole 40*h* by the predetermined distance. The connection of the through hole 12*b* and the holding hole 40*h* and the engagement of the tubular portion 42 and the receiving hole 12*h* position the coupling base 40 relative to the motor housing member 12. This restricts rotation of the coupling base 40 about the set of metal terminals 36 relative to the motor housing member 12 when coupling the coupling base 40 to the motor housing member 12. Thus, the coupling of the coupling base 40 to the motor housing member 12 is facilitated.

(2) The coupling base 40 includes the tubular portion 42 forming the communication passage 42*a* that communicates the refrigerant passage 41 and the interior of the motor housing member 12. In addition, the end wall 12*a* of the motor housing member 12 includes the receiving hole 12*h* that receives the tubular portion 42. In the prior art, a communication passage that communicates the refrigerant passage 41 and the interior of the motor housing member 12 may be formed by positioning the coupling base 40 relative the motor housing member 12 such that a communication hole formed in the coupling base 40 overlaps with a communication hole formed in the motor housing member 12. Compared to such a structure, the present embodiment effectively restricts leakage of refrigerant from the communication passage 42*a* through the gap between the coupling base 40 and the motor housing member 12. Furthermore, in the conventional structure described above, the communication holes may be misaligned from each other thus hindering the communication between the refrigerant passage 41 and the interior of the motor housing member 12. In the present embodiment, the communication between the refrigerant passage 41 and the interior of the motor housing member 12 through the communication passage 42*a* can be achieved merely by inserting the tubular portion 42 into the receiving hole 12*h*.

(3) The seal member 42*s* is arranged between the tubular portion 42 and the receiving hole 12*h*. The seal member 42*s* seals the gap between the tubular portion 42 and the wall of the receiving hole 12*h*. In addition, the seal member 42*s* can elastically deform to absorb dimensional variations of the tubular portion 42 and the receiving hole 12*h*. This further facilitates the coupling of the coupling base 40 to the motor housing member 12.

(4) The heat insulator 43 is arranged between the end wall 12*a* of the motor housing member 12 and the coupling base 40. The heat insulator 43 limits the transfer of heat from the hot highly-pressurized refrigerant, compressed in the compression unit 18, to the coupling base 40 through the motor housing member 12. This further improves the cooling capability of the motor driving circuit 30.

(5) The refrigerant passage 41 overlaps with the arrangement portion 40*a* on which the electric components including the switching elements 30*b* are arranged. This effectively cools the electric components including the switching elements 30*b*, which emit more heat than other components of the motor driving circuit 30, and further improves the cooling capability of the motor driving circuit 30. The improved cooling capability of the electric components including the switching elements 30*b* allows the electric components to have lower heat resistance. This reduces the costs.

(6) The compression unit 18, the electric motor 19, and the motor driving circuit 30 are arranged in this order along the axis of the rotation shaft 23. This reduces the size of the motor-driven compressor 10 in the axial direction of the rotation shaft 23 compared to when the cover 31 and the coupling base 40 are coupled to the circumferential wall of the motor housing member 12 and the motor driving circuit 30 is located radially outward from the rotation shaft 23. In the prior art, when the compression unit 18, the electric motor 19, and the motor driving circuit 30 are arranged in this order along the axis of the rotation shaft 23, the refrigerant drawn into the motor housing member 12 cools the motor driving circuit 30. In the present embodiment, the refrigerant flowing in the refrigerant passage 41 formed in the coupling base 40 exchanges heat with the motor driving circuit 30 through the coupling base 40. This limits heating of the refrigerant that cools the motor driving circuit 30 with the hot highly-pressurized refrigerant that is compressed in the compression unit 18, and improves the cooling capability of the motor driving circuit 30 compared to a structure in which the refrigerant drawn in the motor housing member 12 cools the motor driving circuit 30. Thus, the cooling capability of the motor driving circuit 30 can be improved even when the compression unit 18, the electric motor 19, and the motor driving circuit 30 are arranged in this order along the axis of the rotation shaft 23.

(7) The compression unit 18, the electric motor 19, and the motor driving circuit 30 are arranged in this order along the axis of the rotation shaft 23. This allows the refrigerant drawn into the motor housing member 12 to cool the electric motor 19.

(8) The compression unit 18, the electric motor 19, and the motor driving circuit 30 are arranged in this order along the axis of the rotation shaft 23. This reduces the intake pulsation.

Second Embodiment

Figure 3:
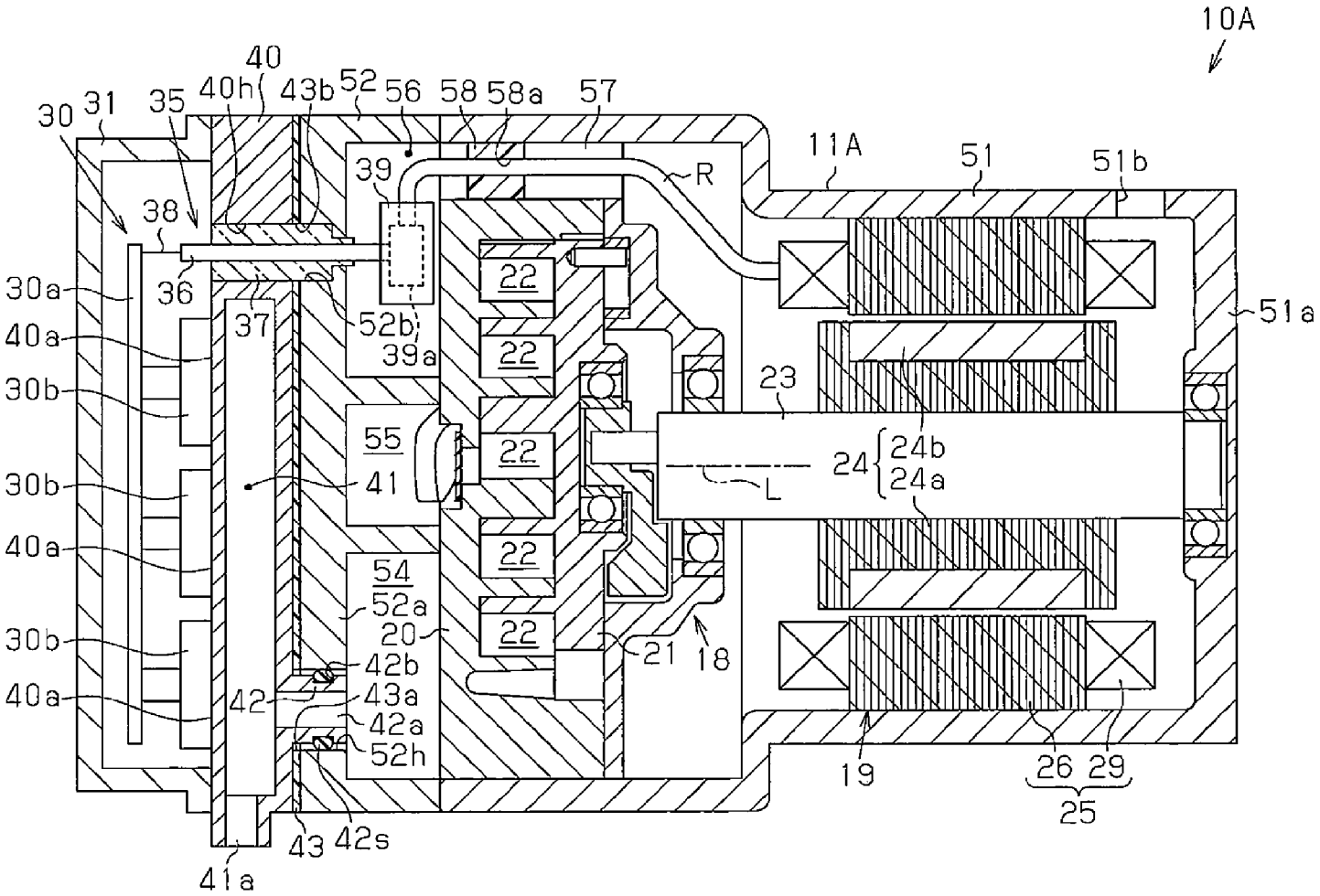
FIG. 3 is a cross-sectional view showing a motor-driven compressor of a second embodiment.

Referring to FIG. 3, the second embodiment of the present invention will now be described. Same reference numerals are given to those components that are the same as the corresponding components of the first embodiment. Such components will not be described in detail.

As shown in FIG. 3, a motor-driven compressor 10A includes a housing 11A that includes a first housing member 51, which is made of metal (aluminum in the present embodiment), and a second housing member 52. The first and second housing members 51 and 52 are cylindrical, and each includes an open end and a closed end. The second housing member 52 is coupled to the open end (left end as viewed in FIG. 3) of the first housing member 51.

The first housing member 51 accommodates the compression unit 18 and the electric motor 19 that are arranged next to each other along the axis of the rotation shaft 23. The electric motor 19 is closer to the end wall 51*a* (right side as view in FIG. 3) of the first housing member 51 than the compression unit 18. The circumferential wall of the first housing member 51 includes a discharge port 51*b*, which is adjacent to the end wall 51*a*.

The cover 31 is coupled to the end wall 52*a* of the second housing member 52. The motor driving circuit 30 is arranged between the second housing member 52 and the cover 31. Accordingly, in the present embodiment, the motor driving circuit 30, the compression unit 18, and the electric motor 19 are arranged in this order along the axis of the rotation shaft 23. The circuit board 30*a* and the electric components including the switching elements 30*b* of the motor driving circuit 30 are arranged on the coupling base 40.

The second housing member 52 and the fixed scroll 20 define an accommodation chamber 56 that accommodates the cluster block 39, a suction chamber 54, and a discharge chamber 55. In addition, an insertion space 57 is formed between the outer surface of the fixed scroll 20 and the inner surface of the first housing member 51. The insertion space 57 communicates the accommodation chamber 56 and the space between the electric motor 19 and the compression unit 18 in the first housing member 51.

Leads R of U, V, and W phases (only one shown in FIG. 3) extend to the insertion space 57 from the end of the coil 29 that faces toward the compression unit 18. The end of each lead R is connected to the corresponding connection terminal 39*a* in the cluster block 39 arranged in the accommodation chamber 56. A restriction member 58 is arranged in the insertion space 57. The restriction member 58 includes an insertion hole 58*a* that receives the leads R. The restriction member 58 restricts the communication between the accommodation chamber 56 and the space between the electric motor 19 and the compression unit 18 in the first housing member 51 through the insertion space 57.

The end wall 52*a* of the second housing member 52 includes a through hole 52*b*, which functions as an insertion portion that receives the sealing terminal 35. Each metal terminal 36 includes the first end, which is electrically connected to the circuit board 30*a* by the cable 38, and the second end, which extends through the through hole 52*b* into the accommodation chamber 56. The connection terminal 39*a* electrically connects each lead R to the second end of the corresponding metal terminal 36.

The end wall 52*a* of the second housing member 52 also includes a receiving hole 52*h*, which functions as a receiving portion that receives the tubular portion 42. The receiving hole 52*h* opens in the suction chamber 54 and extends through the end wall 52*a* of the second housing member 52 parallel to the inserting direction of the metal terminals 36.

The operation of the second embodiment will now be described.

The refrigerant supplied through the supply port 41*a* flows into the refrigerant passage 41 and is drawn into the suction chamber 54 through the communication passage 42*a*. The refrigerant flowing in the refrigerant passage 41 in the coupling base 40 cools the motor driving circuit 30. The refrigerant drawn into the suction chamber 54 is then sent to the compression chamber 22 through a passage (not shown) formed in the fixed scroll 20 and compressed in the compression chamber 22. The compressed refrigerant is discharged into the discharge chamber 55 and then sent to the space between the electric motor 19 and the compression unit 18 through a passage (not shown) formed in the first housing member 51. The refrigerant then flows through the discharge port 51*b* into the external refrigerant circuit and returns to the supply port 41*a*.

Accordingly, the second embodiment has the following advantages in addition to advantages (1) to (5) of the first embodiment.

(9) In the prior art, when the motor driving circuit 30, the compression unit 18, and the electric motor 19 are arranged in this order along the axis of the rotation shaft 23, it would be difficult to cool the motor driving circuit 30 with the refrigerant since the motor driving circuit 30 is arranged next to the compression unit 18. In the present embodiment, however, the refrigerant flowing in the refrigerant passage 41 of the coupling base 40 exchanges heat with the motor driving circuit 30 through the coupling base 40. This improves the cooling capability of the motor driving circuit 30 even when the motor driving circuit 30, the compression unit 18, and the electric motor 19 are arranged in this order along the axis of the rotation shaft 23.

(10) The motor driving circuit 30, the compression unit 18, and the electric motor 19 are arranged in this order along the axis of the rotation shaft 23. This reduces the discharge pulsation.

(11) The motor driving circuit 30, the compression unit 18, and the electric motor 19 are arranged in this order along the axis of the rotation shaft 23. This reduces the size of the motor-driven compressor 10 in the axial direction of the rotation shaft 23 compared to when the cover 31 and the coupling base 40 are coupled to the circumferential wall of the motor housing member 12 and the motor driving circuit 30 is located radially outward from the rotation shaft 23, for example.

It should be apparent to those skilled in the art that the present invention may be embodied in many other specific forms without departing from the spirit or scope of the invention. Particularly, it should be understood that the present invention may be embodied in the following forms.

Figure 4:
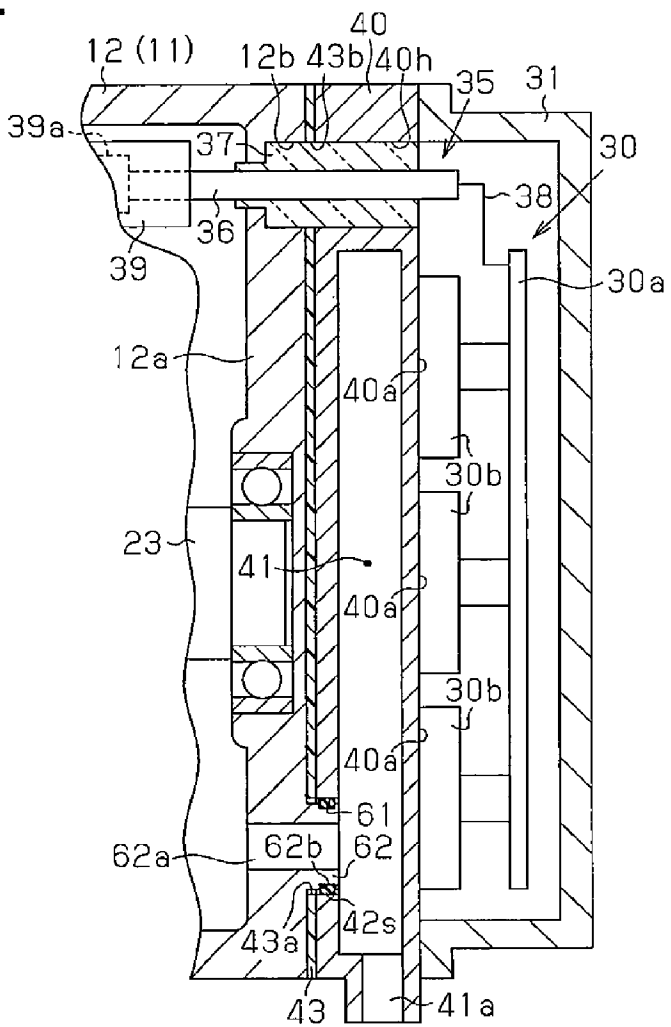
FIG. 4 is a partially enlarged view showing a motor-driven compressor of another embodiment.

As shown in FIG. 4, the end wall 12*a* of the motor housing member 12 may include a tubular portion 62 that is a protrusion extending parallel to the inserting direction of the metal terminals 36. The tubular portion 62 may be formed at a position separated from the through hole 12*b* by a predetermined distance. The tubular portion 62 includes a communication passage 62*a* communicating the refrigerant passage 41 and the interior of the motor housing member 12. In addition, the coupling base 40 may include a receiving hole 61, which functions as a receiving portion that receives the tubular portion 62. The receiving hole 61 extends through the coupling base 40 parallel to the inserting direction of the metal terminals 36. The tubular portion 62 includes a holding groove 62*b* that extends over the entire outer circumference of the tubular portion 62. The holding groove 62*b* holds the seal member 42*s* that seals the gap between the tubular portion 62 and the wall of the receiving hole 61.

Figure 5:
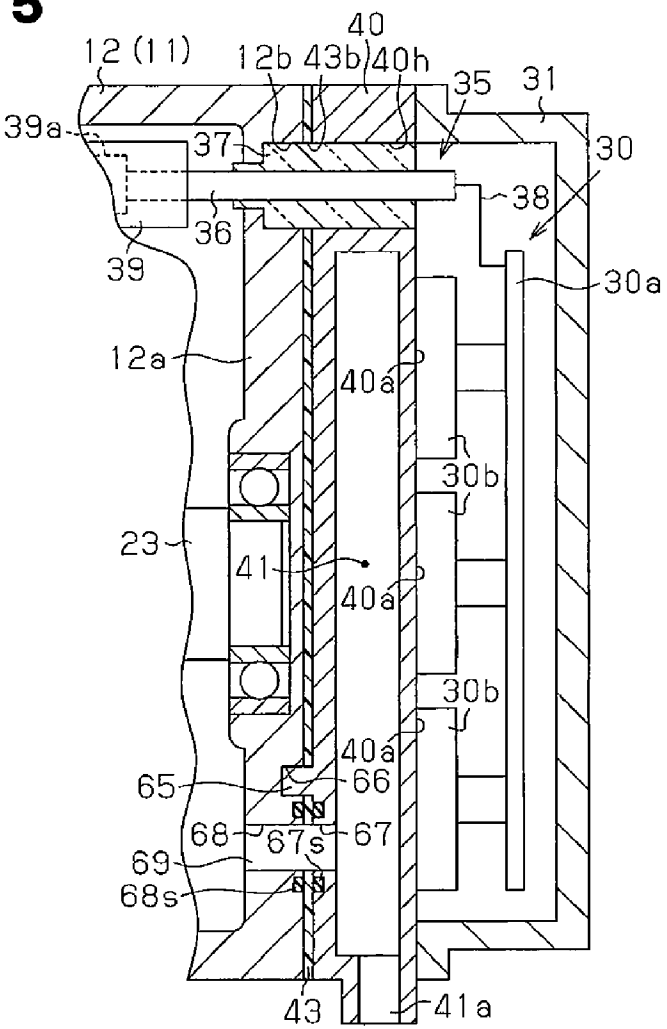
FIG. 5 is a partially enlarged view showing a motor-driven compressor of further embodiment.

As shown in FIG. 5, the coupling base 40 may include a protrusion 65 extending parallel to the inserting direction of the metal terminals 36. In addition, the end wall 12*a* of the motor housing member 12 may include a receiving portion 66 that receives the protrusion 65. In this case, a communication passage 69 communicating the refrigerant passage 41 and the interior of the motor housing member 12 may be formed by arranging the coupling base 40 and the motor housing member 12 such that a communication hole 67 formed in the coupling base 40 and a communication hole 68 formed in the end wall 12*a* of the motor housing member 12 overlap with each other. An annular first seal member 67*s* may be arranged around the communication hole 67 on the surface of the coupling base 40 that faces toward the motor housing member 12. The first seal member 67*s* restricts leakage of refrigerant from the communication passage 69 through the gap between the coupling base 40 and the heat insulator 43. In addition, an annular second seal member 68*s* may be arranged around the communication hole 68 on the surface of the end wall 12*a* of the motor housing member 12 that faces toward the coupling base 40. The second seal member 68*s* restricts leakage of refrigerant from the communication passage 69 through the gap between the end wall 12*a* and the heat insulator 43. Alternatively, the end wall 12*a* of the motor housing member 12 may include a protrusion extending parallel to the inserting direction of the metal terminals 36, and the coupling base 40 may include a receiving portion that receives the protrusion.

Figure 6:
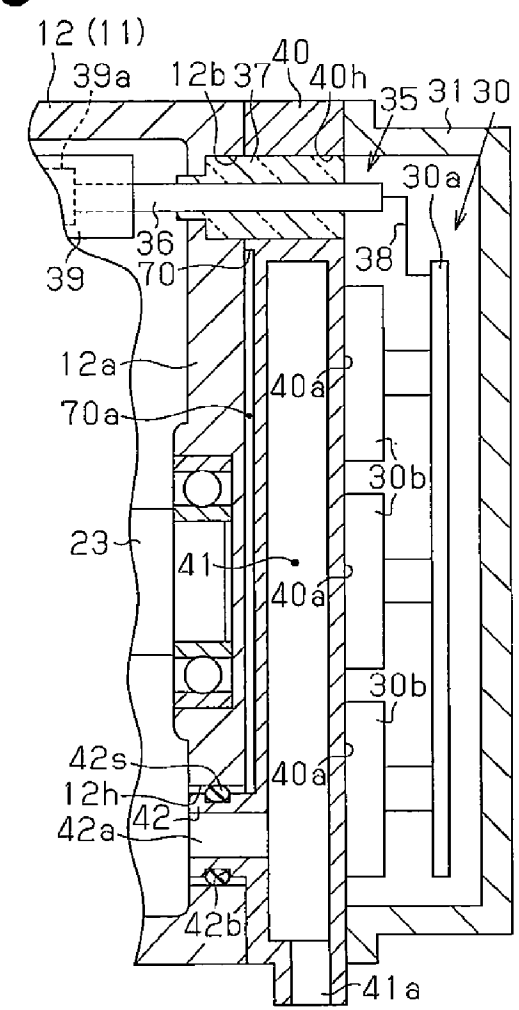
FIG. 6 is a partially enlarged view showing a motor-driven compressor of yet another embodiment.

As shown in FIG. 6, the heat insulator 43 may be omitted. Instead, the surface of the coupling base 40 that faces toward the motor housing member 12 may include a recess 70 extending along the refrigerant passage 41. The recess 70 and the end wall 12*a* of the motor housing member 12 define a cavity 70*a* that functions as a heat insulation layer. The cavity 70*a* reduces the contact area between the end wall 12*a* and the coupling base 40. The cavity 70*a* inhibits the heat of the hot highly-pressurized refrigerant that is compressed in the compression unit 18 from being transmitted to the coupling base 40 through the motor housing member 12. In another embodiment, the heat insulator 43 is not omitted, and the cavity 70*a* is defined by the recess 70 and the heat insulator 43.

Figure 7:
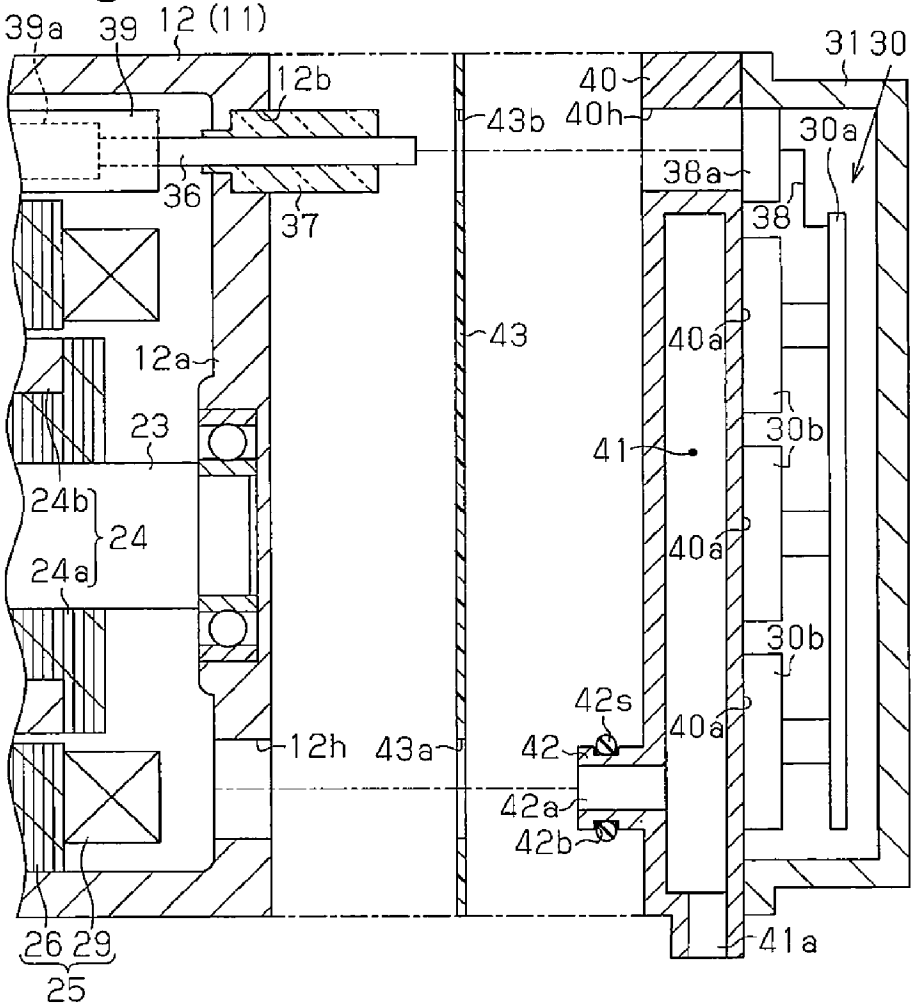
FIG. 7 is a cross-sectional view showing a cover and a coupling base of yet another embodiment before assembly to a motor housing member.

As shown in FIG. 7, when assembling the cover 31 and the coupling base 40 to the end wall 12*a* of the motor housing member 12, the metal terminal 36 may be arranged in the through hole 12*b* of the motor housing member 12 in advance. The second end of each metal terminal 36 is electrically connected to the corresponding connection terminal 39*a*. The assembly of the coupling base 40 to the motor housing member 12 electrically connects the first end of each metal terminal 36 to a connection terminal 38*a* of the cable 38.

The seal member 42*s* between the tubular portion 42 and the wall of the receiving hole 12*h* may be omitted. In this case, it is preferable that two seal members are arranged around the tubular portion 42, one between the coupling base 40 and the heat insulator 43 and the other between the end wall 12*a* of the motor housing member 12 and the heat insulator 43.

The cover 31 and the coupling base 40 may be coupled to the circumferential wall of the motor housing member 12. Further, the motor driving circuit 30 may be located radially outward from the rotation shaft 23.

The compression unit 18 may be of a piston type or a vane type.

The invention claimed is:

1. A motor-driven compressor comprising:

a compression unit adapted to compress refrigerant;

an electric motor adapted to drive the compression unit;

a housing that accommodates the compression unit and the electric motor;

a cover coupled to the housing;

a motor driving circuit arranged between the housing and the cover and adapted to drive the electric motor;

a metal terminal that electrically connects the electric motor to the motor driving circuit;

a coupling base disposed outside of the housing and coupled to the housing, the coupling based including a first side surface facing the cover and an opposing second side surface facing an end wall of the housing, wherein the motor driving circuit is coupled to the first side surface of the coupling base; and the end wall of the housing is coupled to the second side surface of the coupling base;

a refrigerant passage, which is an internal is space formed within the coupling base, wherein the refrigerant flows in the refrigerant passage: and, a supply port formed in the coupling base to connect the refrigerant passage to an external refrigerator circuit, wherein each of the coupling base and the housing includes an insertion hole through which the metal terminal is inserted in an inserting direction, one of the coupling base and the housing includes a tubular protrusion portion that extends in a direction parallel to the inserting direction, wherein the tubular protrusion portion is separated from the insertion holes by a predetermined distance, the other of the coupling base and the housing includes a receiving hole that receives the tubular protrusion portion inside the receiving hole, the coupling base is positioned relative to the housing by insertion of the metal terminal into the insertion holes of the coupling base and the housing and by insertion of the tubular protrusion portion into the receiving hole in the direction parallel to the inserting direction of the metal terminal, and a communication passage is formed in the tubular protrusion portion to communicate the refrigerant passage of the coupling base and an interior of the housing to each other.

2. The motor-driven compressor according to claim 1, further comprising a seal member that seals a gap between the tubular portion and a wall of the receiving hole.

3. The motor-driven compressor according to claim 1, further comprising a heat insulation layer between the housing and the coupling base.

4. The motor-driven compressor according to claim 1, wherein the motor driving circuit includes a heat emitting component arranged on the coupling base, and the refrigerant passage overlaps with a portion of the coupling base on which the heat emitting component is arranged.

5. The motor-driven compressor according to claim 1, wherein the housing accommodates a rotation shaft that rotates integrally with a rotor of the electric motor, and the compression unit, the electric motor, and the motor driving circuit are arranged in this order along an axis of the rotation shaft.

6. The motor-driven compressor according to claim 1, wherein the housing accommodates a rotation shaft that rotates integrally with a rotor of the electric motor, and the motor driving circuit, the compression unit, and the electric motor are arranged in this order along an axis of the rotation shaft.

7. The motor-driven compressor according to claim 1, wherein an insulator is provided around the metal terminal, and the insertion holes of the coupling base and the housing hold the insulator.

8. A motor-driven compressor comprising:

a compression unit adapted to compress refrigerant;

an electric motor adapted to drive the compression unit;

a housing that accommodates the compression unit and the electric motor;

a cover coupled to the housing;

a motor driving circuit arranged between the housing and the cover and adapted to drive the electric motor;

a metal terminal that electrically connects the electric motor to the motor driving circuit;

a planar coupling base disposed outside of the housing and coupled to the housing, the planar coupling base including a first side surface facing the cover and an opposing second side surface facing an end wall of the housing, wherein the motor driving circuit is coupled to the first side surface of the planar coupling base, and the end wall of the housing is coupled to the second side surface of the planar coupling base;

a refrigerant passage defined by an interior of the first side surface and the second side surface of the planar coupling base, wherein the refrigerant flows in the refrigerant passage; and a supply port formed in the planar coupling base to connect the refrigerant passage to an external refrigerant circuit, wherein each of the planar coupling base and the housing includes an insertion hole through which the metal terminal is inserted in an inserting direction, wherein a first end of the metal terminal extends through the insertion hole of the planar coupling base and is electrically connected to the motor driving circuit by a cable and a second end of the metal terminal extends through the insertion hole of the housing and into the housing, one of the second side surface of the planar coupling base and the end wall of the housing includes a tubular protrusion portion that extends in a direction parallel to the inserting direction, wherein the tubular protrusion portion is separated from the insertion holes by a predetermined distance, the other of the second side surface of the planar coupling base and the end wall of the housing includes a receiving hole that receives the tubular protrusion portion into an interior the receiving hole, the planar coupling base is positioned relative to the housing by insertion of the metal terminal into the insertion holes of the planar coupling base and the housing and by insertion of the tubular protrusion portion inside the receiving hole in the direction parallel to the inserting direction of the metal terminal, and a communication passage is formed in the tubular protrusion portion to communicate the refrigerant passage of the planar coupling base and an interior of the housing to each other.

9. The motor-driven compressor according to claim 8, wherein the tubular protrusion portion is arranged in one of second side surface of the coupling base and the end wall of the housing and forms the communication passage, the receiving portion is arranged in the other one of the second side surface of the coupling base and the end wall of the housing to receive the tubular protrusion portion.

10. The motor-driven compressor according to claim 9, further comprising a seal member that seals a gap between the tubular protrusion portion and a wall of the receiving hole.

11. The motor-driven compressor according to claim 8, further comprising a heat insulation layer between the end wall of the housing and the second side surface of the coupling base, the heat insulation layer including a first through hole which receives the tubular protrusion portion.

12. The motor-driven compressor according to claim 8, wherein the motor driving circuit includes a heat emitting component arranged on the coupling base, and the refrigerant passage overlaps with a portion of the coupling base on which the heat emitting component is arranged.

13. The motor-driven compressor according to claim 8, wherein the housing accommodates a rotation shaft that rotates integrally with a rotor of the electric motor, and the compression unit, the electric motor, and the motor driving circuit are arranged in this order along an axis of the rotation shaft.

14. The motor-driven compressor according to claim 8, wherein the housing accommodates a rotation shaft that rotates integrally with a rotor of the electric motor, and the motor driving circuit, the compression unit, and the electric motor are arranged in this order along an axis of the rotation shaft.

15. The motor-driven compressor according to claim 8, wherein an insulator is provided around the metal terminal, and the insertion holes of the planar coupling base and the housing hold the insulator.

* * * * *